US009695622B2

(12) United States Patent
Bongiovanni

(10) Patent No.: US 9,695,622 B2
(45) Date of Patent: Jul. 4, 2017

(54) HINGES SYSTEM

(71) Applicant: INDUSTRIA CASEARIA SILVIO BELLADELLI S.R.L., Villafranca di Verona (IT)

(72) Inventor: Claudio Bongiovanni, Villafranca di Verona (IT)

(73) Assignee: INDUSTRIA CASEARIA SILVIO BELLADELLI S.R.L., Villafranca di Verona (IT)

( * ) Notice: Subject to any disclaimer, the term of this patent is extended or adjusted under 35 U.S.C. 154(b) by 0 days.

(21) Appl. No.: 14/890,290

(22) PCT Filed: May 26, 2014

(86) PCT No.: PCT/IB2014/061720

§ 371 (c)(1),
(2) Date: Nov. 10, 2015

(87) PCT Pub. No.: WO2014/191897

PCT Pub. Date: Dec. 4, 2014

(65) Prior Publication Data

US 2016/0145924 A1 May 26, 2016

(30) Foreign Application Priority Data

May 27, 2013 (IT) ..... VR2013A0127

(51) Int. Cl.
*E05F 3/20* (2006.01)
*E05F 1/06* (2006.01)
(Continued)

(52) U.S. Cl.
CPC ..... *E05F 3/20* (2013.01); *E05F 1/065* (2013.01); *E05F 1/1223* (2013.01); *E05F 3/12* (2013.01);
(Continued)

(58) Field of Classification Search
CPC . E05F 1/065; E05F 1/1223; E05F 3/12; E05F 3/20
(Continued)

(56) References Cited

U.S. PATENT DOCUMENTS 1,698,390 A 1/1929 Carpenter et al.
2,018,564 A * 10/1935 Milly ..... E05F 3/20 16/374
(Continued)

FOREIGN PATENT DOCUMENTS

| | | |
|---|---|---|
| DE | 151070 C | 5/1904 |
| EP | 1 944 447 A2 | 7/2008 |
| JP | H05-5389 A | 1/1993 |

OTHER PUBLICATIONS

International Search Report, dated Jul. 16, 2014, from corresponding PCT Application.

*Primary Examiner* — Roberta Delisle
(74) *Attorney, Agent, or Firm* — Young & Thompson

(57) ABSTRACT

A hinges structure (10) includes a first hinge (12) and a second hinge (14), each of them being fixed at a part to a fixed system F and at the other part to a wing B. The hinges structure (10) includes a cam mechanism for an automatic closing of the wing B and a fluid-operated device adapted to move a fluid from a first chamber to a second chamber through the rotational motion of the wing B. The speed of displacement of the fluid may be conveniently adjusted through a valve and consequently, the closing speed of the wing may be controlled.

12 Claims, 4 Drawing Sheets

(51) Int. Cl.
*E05F 1/12* (2006.01)
*E05F 3/12* (2006.01)

(52) U.S. Cl.
CPC ..... *E05Y 2800/22* (2013.01); *E05Y 2900/132* (2013.01)

(58) Field of Classification Search
USPC ..... 16/51–53, 54, 274, 275, 277
See application file for complete search history.

(56) References Cited

U.S. PATENT DOCUMENTS 2,490,258 A * 12/1949 Diebel ..... E05F 3/20 16/54
2,565,728 A * 8/1951 Hopkins ..... E05B 83/10 160/210
3,241,177 A * 3/1966 Anderson ..... E05D 7/081 16/275
3,401,422 A * 9/1968 Ventura ..... E05F 1/061 16/317
4,068,344 A * 1/1978 Okabe ..... E05F 3/20 16/54
4,155,144 A * 5/1979 Koganei ..... E05F 3/20 16/54
4,200,957 A * 5/1980 Hsu ..... E05F 1/066 16/314
4,756,051 A * 7/1988 Shy ..... E05F 3/14 16/299
4,829,628 A * 5/1989 Vuksic ..... E05F 3/20 16/299
5,572,768 A * 11/1996 Daul ..... E05F 1/1215 16/337
5,701,636 A * 12/1997 Jahnke ..... E05D 7/0423 16/237
5,855,040 A * 1/1999 Lin ..... E05D 5/10 16/50
6,205,619 B1 * 3/2001 Jang ..... E05D 5/10 16/352
6,658,694 B2 * 12/2003 Wang ..... E05F 1/1223 16/284
7,966,693 B2 * 6/2011 Choi ..... E05F 3/20 16/284
9,416,573 B2 * 8/2016 Sabrowski ..... E05D 7/0415
2008/0196313 A1 * 8/2008 Fink ..... E06B 7/20 49/380

* cited by examiner

HINGES SYSTEM

The present invention refers, in general, to a hinges system to connect a wing to a fixed system. More particularly, the present invention concerns a hinges system comprising hinges for the connection of a wing such as a shutter or a door to the fixed system, this hinges system acting as a closer.

The hinges acting as a closer according to prior art usually comprise a cam mechanism or a rack mechanism with return spring. For instance, in the opening movement of the wing fixed to the hinge, the cam mechanism compresses and loads the spring that consequently extends once the wing has been released so as to move the wing in the opposite direction in order to close it.

For the adjustment of the closing speed of the wing, the closers of the prior art comprise a fluid-operated device in which a piston in its translating motion corresponding to the rotation of the wing in the closing phase displaces a fluid from a first chamber to a second chamber.

By varying the dimensions of the cross section of the conduit for the passage of the fluid between the two chambers, it is possible to adjust the speed of the fluid itself and consequently, to adjust also the closing speed of the wing.

Besides, the conduit may be provided with a valve through which the user may vary the dimension of the area of passage of the fluid and consequently, may vary the closing speed of the wing.

However, the door closers of the prior art have some problems. The most important problems are the encumbrance or the complexity of the installation.

Most aerial door closers operate by using a rack and are installed externally to the wing and therefore, these devices are cumbersome and unpleasant to see.

The floor closers are embedded in the floor and are, therefore, not cumbersome since common hinges of normal dimensions are used on the wing. The main problem of these door closers is the installation. In fact, it is necessary to form a recess in the floor, which is problematic both technically because the floors are lower and therefore, it is necessary to have a very lowered door closer, and economically because the cost of labour is certainly not small for the cutting of the floor and for the masonry work needed to secure the box containing the device.

Accordingly, hinges having the function of door closers have been conceived in order to avoid the use of unwanted aerial closers or to avoid a particular working in the floor. Obviously, said hinges are larger than the normal hinges.

In fact, the known door closers have to include both the cam system or the rack system with the presence of a spring, and the fluid-operated device adjusting the speed so that these closers are rather cumbersome, which does not make easy their application to doors or shutters.

An aim of the present invention is to remove the above drawbacks and other ones through a hinges system with function of door closer showing contained dimensions.

Another aim of the invention is to realize a hinges system with function of door closer that does not affect the whole appearance of the wing and avoids having to perform unwanted excavation in the floor.

A further aim of the invention is to realize a hinges system with function of door closer having a simple structure so as not to be subject to frequent breakdowns.

The above-mentioned aims and others are all achieved according to the present invention through a hinges system with function of door closer, comprising a first hinge and a second hinge, each of them being fixed at a part to a fixed system F and at the other part to a wing B. The hinges system according to the invention comprises a cam mechanism for an automatic closing of the wing B once it has been opened and released, and a fluid-operated device adapted to move a fluid from a first chamber to a second chamber through the rotational motion of the wing B in order to control the closing speed of the wing B.

In particular, the hinges system according to the invention is characterized by the fact that the first hinge comprises a cam mechanism and the second hinge comprises a fluid-operated device.

Through this configuration, the operating mechanisms of the system with function of door closer are divided into at least two distinct hinges whose dimensions are thus smaller than those of a hinge with function of door closer comprising all the mechanisms.

Advantageously, the first hinge may comprise a fixed part, fixed to the fixed system F, and a movable part, fixed to the wing B; the movable part being rotating and translating with respect to the fixed part. In this way, it is possible to obtain an article of simple structure and little subject to breakage.

Besides, the fixed part may comprise a first fixed body which is fixed to the fixed system F. To the first fixed body, a first shaft may be rigidly coupled and a first roller may be rotatably coupled. At the same time, the movable part may comprise a first rotating body in which a first hole is obtained and which comprises a first ramp. Thus, the first shaft may be received in the first hole so that the first rotating body may rotate around the first shaft and the first roller may go in abutment and be adapted to roll on the first ramp.

Through this configuration, in the rotational motion of the first rotating body with respect to the first fixed body, the first rotating body is also forced to translate in the direction of development of the first shaft with the consequent lifting of the wing.

Advantageously, the first roller and the first ramp have homologous radii so as to obtain a lower rolling friction and an optimal fluidity of the mechanisms.

In addition, the fixed part may comprise a spring an end of which is fixed to the first shaft, and the movable part may comprise an abutment body on which the free end of the spring abuts. In this way, the rotational motion in a first sense and the translational motion according to a first direction of the movable body with respect to the fixed body, corresponding to the opening of the wing B, is counteracted by the spring so as to load the spring and obtain a rotational motion in an opposite sense and a translational motion according to a second direction opposite to the first one, corresponding to the automatic closing of the wing B.

The closure of the wing takes place not only through a spring that has been preloaded by the opening motion of the wing, but also owing to the weight of the wing itself that in the opening position is raised with respect to the closing position.

A stroke end element is fixed to the first shaft and is adapted to block in abutment a blocking element fixed to the movable body so that the blocking element abuts on the stroke end element in a position of maximum opening of the wing.

Besides, during both the opening phase and the closing phase of the wing B, the upper end of the blocking element follows the profile of the lower inclined surface of the stroke end element. This conformation ensures that there will be no sudden movements of the wing, especially in the closing phase. In particular, the wing itself is prevented from slamming during the closing phase since the wing is guided and cushioned by the particular movement of the beating element with respect to the stroke end element.

Like the first hinge, in order to simplify the structure of the mechanisms, the second hinge may comprise a fixed piece, fixed to the fixed system F, and a movable piece, fixed to the wing B, the movable piece being rotating and translating with respect to the fixed piece.

Advantageously, the fixed piece may comprise a second fixed body which is fixed to the fixed system F and to which a second shaft is rigidly coupled. A piston may be fixed to the free end of the second shaft. The movable piece may comprise a second rotating body in which a second hole is obtained and receives a gasket. The second shaft may be received in the second hole so as to obtain a closed volume which the piston divides into a first chamber and a second chamber, the two chambers being communicating with each other through a conduit. Through this configuration, in the translational motion of the movable piece with respect to the fixed piece, a fluid contained in the first chamber and in the second chamber may pass from one chamber to the other one so as to adjust the speed of motion of the various pieces and consequently, the closing speed of the wing B.

Advantageously, a valve may be comprised and works in the conduit to regulate the passage of fluid in the conduit.

Besides, a second roller is rotatably coupled to the second fixed body, and the movable piece may comprise a second ramp; since the second roller is in abutment and adapted to roll on the second ramp, even the second rotating body may rotate around the second shaft and in the rotational motion of the second rotating body with respect to the second fixed body, the second rotating body is also forced to translate in the direction of development of the second shaft.

In this way, also the second hinge supports the wing B.

In addition, the movable part may comprise a first bushing through which the first shaft passes and in which the first ramp is formed and likewise, the movable piece may comprise a second bushing through which the second shaft passes and in which the second ramp is formed, in order to ensure a perfect coaxiality of the shafts with respect to the movable body and the movable piece as well as a fluidity in the rotation.

Further features and details of the invention will be better understood from the following description that is supplied as a non-restricting example as well as from the accompanying drawing, wherein.

With reference to the accompanying figures, number 10 denotes a hinges system on the whole, acting as a door closer adapted to fix a wing, in the illustrated case a door B, to a fixed system, namely the doorpost F, and at the same time, to allow an automatic closing by gravity when the wing B is opened and released.

Figure 1:
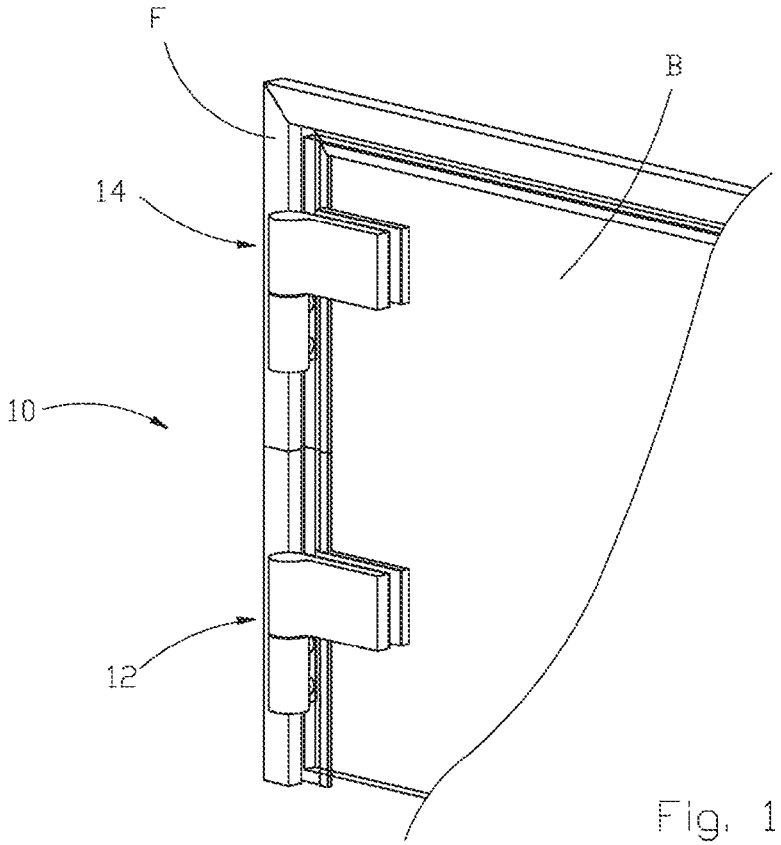
FIG. 1 is an axonometric view of a wing fixed to the fixed system with the hinges system according to the invention comprising a first lower hinge and a second upper hinge.

The hinges system 10 as illustrated in FIG. 1 comprises a first hinge 12 and a second hinge 14, fixed lower than the first hinge 12.

Figure 2:
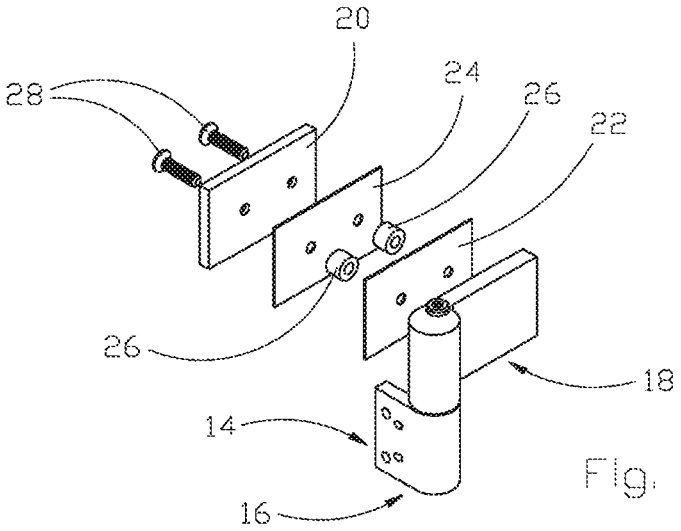
FIG. 2 is an axonometric exploded view of one of the two hinges of the hinges system in FIG. 1, and precisely the second hinge.

The second hinge 14 like the first hinge 12 is fixed with a first part, called fixed part 16 below, to the fixed system F and with a second part, called movable part 18 below, to the wing B. More particularly, as illustrated in FIG. 2, the wing B is fixed at a part to the movable part 18 of the second hinge 14 with the interposition of a first bearing plate 22 acting as a gasket and at the other part to a plate 20 with the interposition of a second bearing plate 24. Two screws 28 fix the wing to the hinge so that the wing B is closed between the plate 20 and the movable part 18 of the second hinge 14. In addition, the screws pass through plastic logs or spacers 26 inserted in the wing B itself.

The first hinge 12 has the same fixing mode to the wing B as the fixing mode just described in relation to the second hinge 14.

Figure 3:
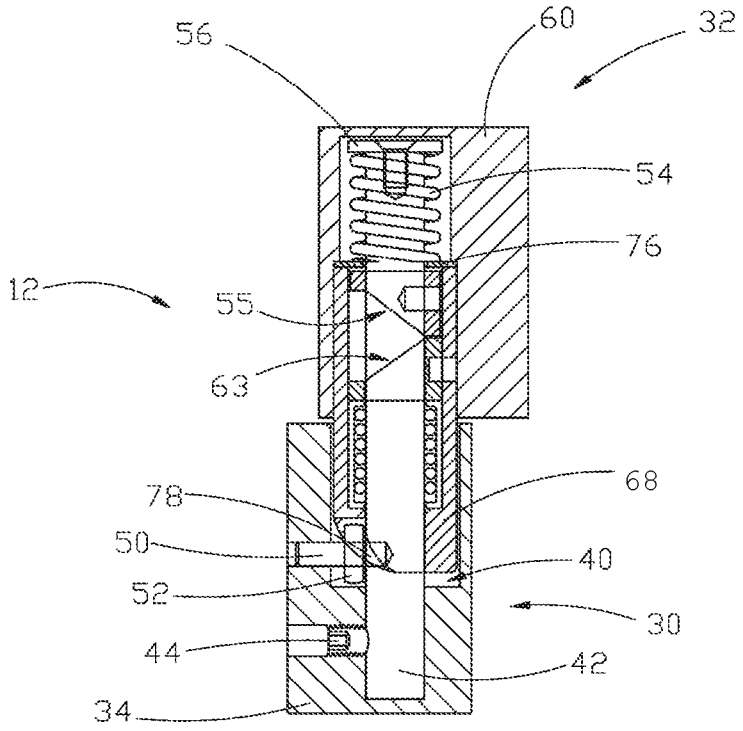
FIG. 3 is a sectional side view of the first hinge in FIG. 1.
Figure 5:
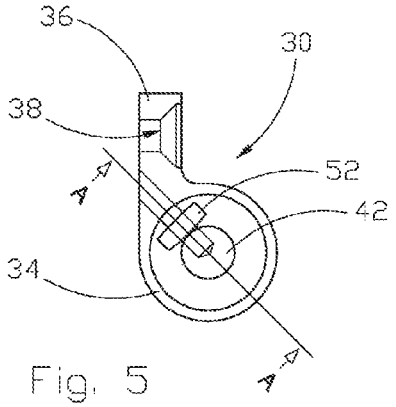
FIG. 5 is a top view of a first part of the first hinge illustrated in FIG. 3.
Figure 6:
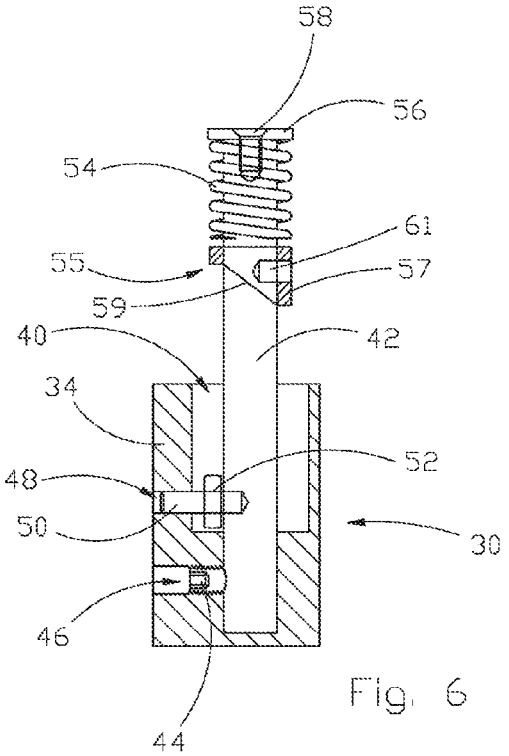
FIG. 6 is a side view of the first part of the first hinge illustrated in FIG. 3, seen in section along the plane indicated with A-A in FIG. 5.
Figure 7:
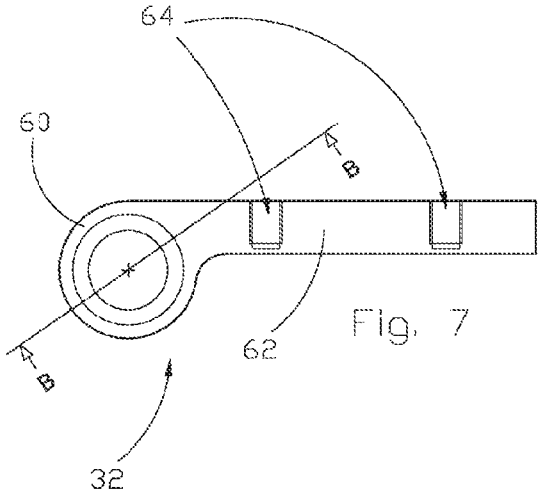
FIG. 7 is a top view of a second part of the first hinge illustrated in FIG. 3.
Figure 8:
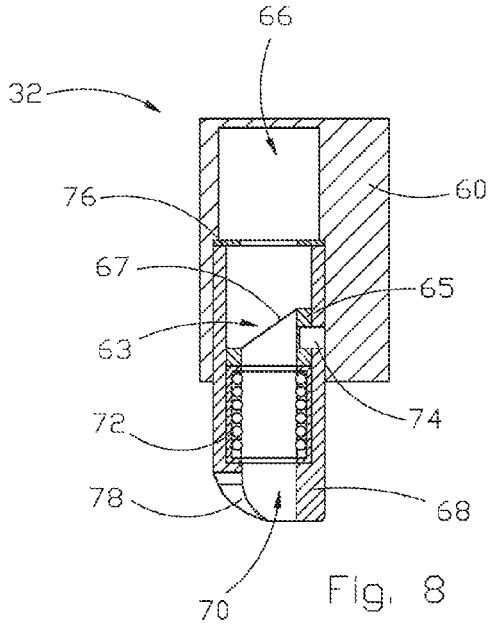
FIG. 8 is a side view of the second part of the first hinge illustrated in FIG. 3, seen in section along the plane indicated with B-B in FIG. 7.

As represented in FIG. 3, the first hinge 12 comprises a fixed part 30, illustrated individually in FIGS. 5, 6, and a movable part 32, illustrated individually in FIGS. 7, 8.

The fixed part 30 comprises a fixed body 30 from which a tongue 36 protrudes. Holes 38 are formed in the tongue 36 for the passage of screws so as to fix the fixed part 30 of the first hinge 12 to the fixed system F.

A first hole 40 is formed in the fixed body 34 and a second blind hole is formed in the fixed body 34, the second hole being coaxial to the first hole and deeper than the first hole. A shaft 42 is inserted in said second blind hole. In particular, the shaft 42 is fixed to the fixed body 34 through a bead 44 inserted and screwed into a first transverse hole 46 which is transversal to the first hole 40 and second hole.

Besides, a second transverse hole 48 is formed in the fixed body 34. A pin 50 is received in said second transverse hole 48 and is transversely inserted also in the shaft 42. A rayed roller 52 is pivoted in the pin 50 and is received in the first hole 40.

The shaft 42 supports a spring 54 around it which is locked, in its upper part, by a washer 56 fixed to the same shaft 42 by means of a screw 58.

Moreover, a stroke end element 55 is fixed to the shaft 42 by means of a screw 61 or other similar element. The stroke end element 55 comprises an upper annular body 57 whose lower surface 59 is inclined.

The movable part 32 of the first hinge 12, illustrated in FIGS. 7, 8, comprises a rotating body 60 from which a flange 62 protrudes. Holes 64 are formed in the flange 62 to fix screws in order to join the movable part 32 of the first hinge 12 to the wing B.

A cylindrical blind hole 66 is formed in the rotating body 60 and has an outer portion whose diameter is greater than the diameter of the inner portion.

A bushing 68 is received in the outer portion of the blind hole 66 and is locked, in the upper part, by a turntable 76. A through hole 70 is formed in said bushing which is fixed to the rotating body 60 by means of a pin 74.

The bushing 68 has a lower surface in which a rayed ramp 78 having an inclined development is formed.

Furthermore, the bushing 68 receives a sleeve 72. A beating element 63 is disposed above said sleeve and comprises a lower annular body 65 whose upper surface 67 is inclined in the opposite direction with respect to the lower surface 59 of the stroke end element 55.

As represented in FIG. 3, the fixed part 30 and the movable part 32 of the first hinge 12 are coupled together in such a way that the shaft 42 passes through the through hole 70 of the bushing 68 and the sleeve 72 so that the upper portion of the same shaft 42 along with the spring 54 and the washer 56 are received in the inner portion of the blind hole 66.

Besides, the roller 52 coupled to the fixed part 30 is in abutment on the ramp 78 and may roll on said ramp when the movable part is rotated.

In fact, when the wing B is opened, the movable part 32 of the first chamber 12 is rotated about the shaft 42. In addition to rotating, the movable part 32 is forced to translate upward because the bushing 68 is raised for the ramp 78 is inclined and the roll 52 rolls on said ramp.

At the same time, also the turntable 76 rotates and translates upward so as to push the lower end of the spring 54 whose upper end is instead blocked by the washer 56.

Thus, the spring is loaded. Once the wing B has been released, the spring pushes the turntable 76 and all the movable part 32 downward. During the translation of the movable part 32 downward, also the counter-rotation of the movable part 32 takes place owing to the rolling of the roller 52 on the ramp 78.

In this way, the wing B is automatically closed through the action of the first hinge 12 in which the spring is present and through the weight of the wing which lowers the movable part 32 by gravity.

The position of maximum opening of the wing corresponds to the abutment position of the upper surface 67 of the beating element 63 in abutment against the lower surface 59 of the stroke end element 55 since also the beating element 63 rotates and raises while the stroke end element 55 remains fixed.

Moreover, in both the opening phase and closing phase of the wing B, the upper end of the beating element 63 follows the profile of the lower surface 59 of the stroke end element 55. This conformation allows that there are no sudden movements of the wing, especially in the closing phase. In particular, it is avoided that the wing itself slams during the closing phase because the wing is cushioned by the particular movement of the beating element 63 with respect to the stroke end element 55.

Figure 4:
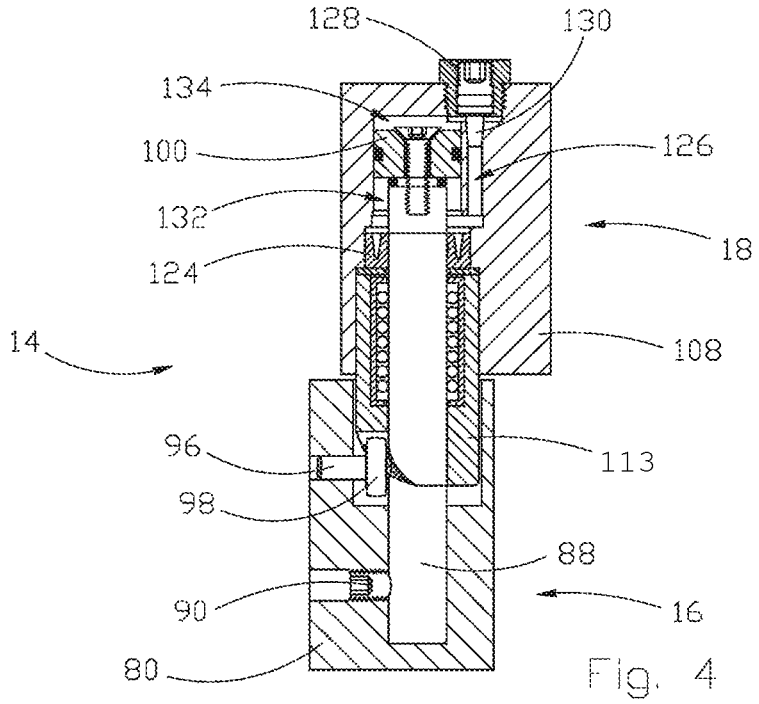
FIG. 4 is a sectional side view of the second hinge in FIG. 1.
Figure 9:
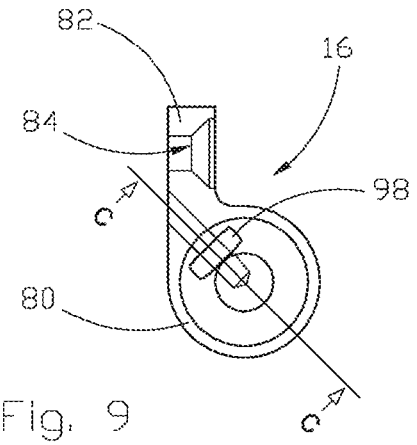
FIG. 9 is a top view of a first part of the second hinge illustrated in FIG. 4.
Figure 10:
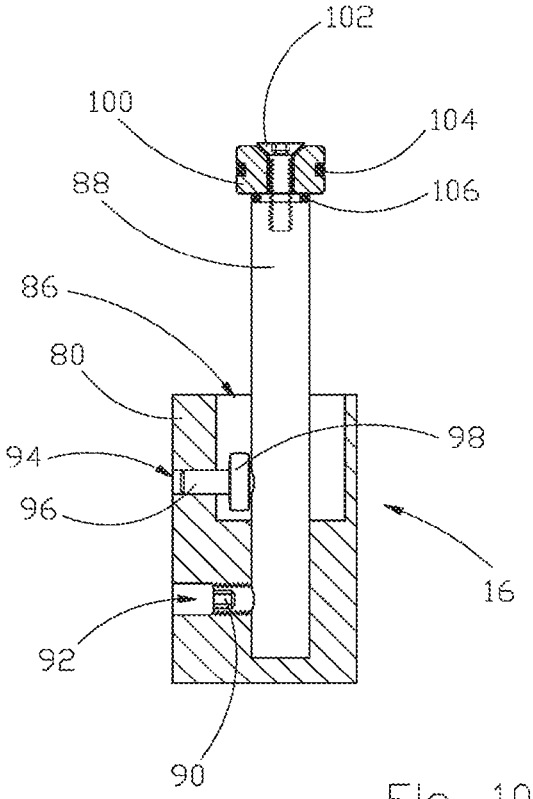
FIG. 10 is a side view of the first part of the second hinge illustrated in FIG. 4, seen in section along the plane indicated with C-C in FIG. 9.
Figure 11:
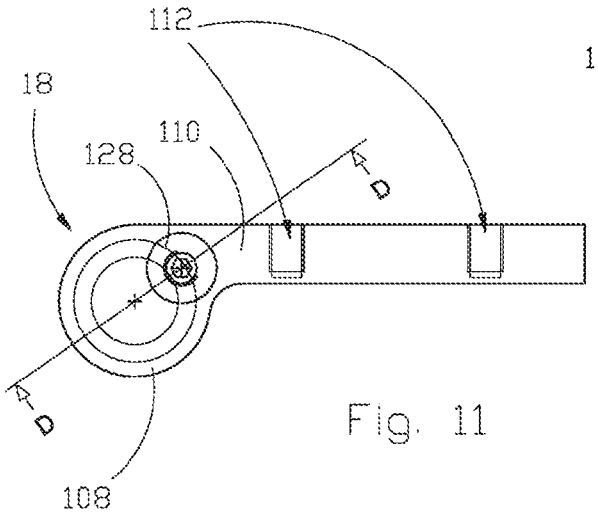
FIG. 11 is a top view of a second part of the second hinge illustrated in FIG. 4.
Figure 12:
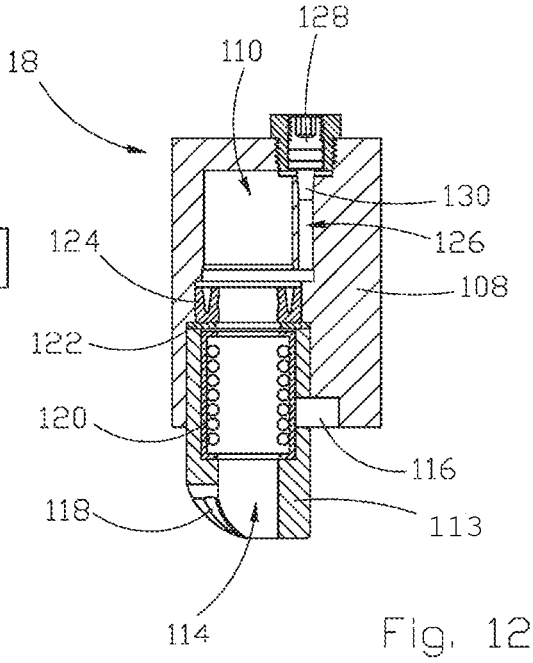
FIG. 12 is a side view of the second part of the second hinge illustrated in FIG. 4, seen in section along the plane indicated with D-D in FIG. 11.

As represented in FIG. 4, the second hinge 14 comprises a fixed part 16, illustrated individually in the FIGS. 9, 10, and a movable part 18, illustrated individually in the FIGS. 11, 12.

Like the first hinge 12, the second hinge 14 comprises a fixed piece 16 and a movable piece 18.

The fixed piece 16 comprises a fixed body 80 from which a tongue 82 protrudes. Holes 84 are formed in the tongue to insert screws so as to fix the fixed piece 16 of the second hinge 14 to the fixed system F.

A first hole 86 and a second blind hole are formed in the fixed body 80, the second blind hole being coaxial to the first hole and deeper than the first hole. A shaft 88 is inserted in the second blind hole. In particular, the shaft 88 is fixed to the fixed body 80 through a bead 90, inserted and screwed into a transverse hole 92 which is transversal to the first hole 86 and second hole.

Besides, a second transverse hole 94 is formed in the fixed body 80. A pin 96 is received in said transverse hole and is inserted transversely also in the shaft 88. A rayed roller 98 is pivoted in the pin 96 and is received in the first hole 86. A piston 100 is fixed to the shaft 88 by means of a screw 102. A first O-ring 104 is disposed around the piston. Furthermore, a second O-ring 106 is interposed between the piston 100 and the shaft 88.

The movable piece 18 of the second hinge 14, illustrated in the FIGS. 11, 12, comprises a rotating body 108 from which a flange 110 protrudes. Holes 112 are formed in said flange to insert screws in order to join the movable piece 18 of the second hinge 14 to the wing B.

A cylindrical blind hole 110 is formed in the rotating body 108 and has an outer portion whose diameter is greater than the diameter of the inner portion.

A bushing 113 is received in the outer portion of the blind hole 110. A through hole 114 is formed in said bushing which is fixed to the same rotating body 108 by means of a pin 116.

The bushing 113 has a lower surface in which a rayed ramp 118 having an inclined development is formed.

Furthermore, the bushing 113 receives a sleeve 120 and is blocked, in the upper part, by a turntable 122 and a gasket 124.

A conduit 126 is formed in the upper part of the rotating body 108 and connects the lower part with the upper part of the inner portion of the blind hole 110.

An adjusting valve 128 may be screwed into the upper part of the rotating body 108 so that a tip 130 of the same valve 128 intersects more or less the transverse area of the conduit 126.

As represented in FIG. 4, the fixed piece 16 and the movable piece 18 of the second hinge 14 are coupled together in such a way that the shaft 88 passes through the through hole 114 of the bushing 113 and the sleeve 120 so that the upper portion of the same shaft 88 together with the piston 100 are received in the inner portion of the blind hole 100.

The piston 100 divides the inner portion of the blind hole 110 into two chambers: a first chamber 132 and a second chamber 134, connected to each other by means of the conduit 126 and containing a fluid.

Besides, the roller 98 coupled to the fixed piece 30 is in abutment on the ramp 118 and may roll on said ramp when the movable part is rotated.

In fact, when the wing B is opened, the movable piece 16 of the second chamber 14 is rotated about the shaft 88. In addition to rotating, the movable piece 16 is forced to translate upward because the bushing 113 is raised for the ramp 118 is inclined and the roll 98 rolls on said ramp. In the same way, also the wing B is raised.

At the same time, also the turntable 122 and the gasket 124 rotate and translate upward while the piston 100 remains fixed in position. In so doing, the first chamber 132 is reduced and the second chamber 134 increases in volume so that the fluid is displaced through the conduit 126 from the first chamber 132 to the second chamber 134.

The position of the tip 130 of the adjusting valve 128 allows to adjust the fluid flow in the conduit 126 and to control also the speed of rotation of the movable piece 18 around the fixed piece 16.

In fact, even when the wing B is released, the movable piece 18 moves downward. At the same time, also the counter-rotation of the same movable piece 18 takes place owing to the rolling of the roller 98 on the ramp 118.

In the motion from top to bottom of the movable piece 18, the fluid is forced to flow through the conduit 126 from the second chamber 134 to the first chamber 132. Also in this case, the passage of fluid in the conduit 126 is adjusted by the position of the adjusting valve 128 so as to control the speed of rotation of the movable piece 18 relative to the fixed piece 16.

Obviously, the user can intervene on the valve 128 to vary the closing speed of the wing B.

The gasket 124 ensures the seal downward of the first chamber 132 even when there is not a perfect interference of the shaft 88 in the through hole 114.

Accordingly, the hinges system as described has a first hinge 12 in which there is the mechanism through which the automatic closing of the wing B takes place, and a second hinge 14 in which, instead, there is the mechanism through which it is possible to adjust the closing speed of the wing B.

Thus, the two functions are performed by two separate, distinct hinges 12, 14 so that it is possible to avoid the encumbrance of a single device comprising all the mechanisms for various functions.

A technician of the sector may conceive other modifications or variants to be intended as included in the scope of protection of the present invention. For instance, he two hinges may be exchanged so as to have a hinge disposed in the lower part and comprising a fluid-operated device for the adjustment of the closing speed of the door, and a hinge disposed above and comprising a cam device necessary to obtain an automatic closing of the door.

Furthermore, the two parts, namely the fixed part and the movable part, of a same hinge may be also exchanged by fixing the part described above as fixed part to the wing and by fixing the part described above as removable part to the fixed system.

The invention claimed is:

1. A hinges system (10) comprising:

a first hinge (12) and a second hinge (14), each of the first and second hinges (12, 14) being fixed at a part to a fixed system F and at the other part to a wing B;

a cam mechanism for an automatic closing of the wing B once the wing B has been opened and released; and a fluid-operated device adapted to move a fluid from a first chamber (132) to a second chamber (134) and vice versa, through rotational motion of the wing B in order to control the closing speed of the wing B, wherein the first hinge (12) comprises a cam mechanism and the second hinge (14) comprises a fluid-operated device, wherein the first hinge (12) comprises a fixed part (30), fixed to the fixed system F, and a movable part (32), fixed to the wing B; the movable part (32) being rotating and translating with respect to the fixed part (30), and wherein the fixed part (30) comprises a first fixed body (34) which is fixed to the fixed system F and to which a first shaft (42) is rigidly coupled and a first roller (52) is rotatably coupled; and wherein the movable part (32) comprises a first rotating body (60) in which a first hole (66) is obtained and which comprises a first ramp (78); the first shaft (42) being received in the first hole (66) so that the first rotating body (60) is rotatable around the first shaft (42); the first roller (52) being in abutment and adapted to roll on the first ramp (78), so that in the rotational motion of the first rotating body (60) with respect to the first fixed body (34), the first rotating body (60) is also forced to translate in the direction of development of the first shaft (42).

2. The hinges system (10) according to claim 1, wherein the first roller (52) and the first ramp (78) have homologous radii.

3. The hinges system (10) according to claim 2, wherein the fixed part (30) comprises a spring (54) an end of which is fixed to the first shaft (42), and wherein the movable part comprises an abutment body (76) on which the free end of the spring (54) abuts, so that the rotational motion in a first sense and the translational motion according to a first direction of the movable body (32) with respect to the fixed body (30) is counteracted by the spring (54) so as to load the spring (54) and obtain a rotational motion in an opposite sense and a translational motion according to a second direction opposite to the first one.

4. The hinges system (10) according to claim 2, wherein a stroke end element (55) is fixed to the first shaft (42), in which element a lower surface (59) inclined is obtained and a blocking element (63) is fixed to the movable body (32) and has an upper surface (67) inclined according to a conformation homologous to that of the stroke end element (55), so that the blocking element (63) abuts on the stroke end element (55) in a position of maximum opening of the wing and that in the closing phase of the wing B, the upper end of the blocking element (63) follows the profile of the lower surface (59) of the stroke end element (55) so as to avoid sudden movements of the wing B.

5. The hinges system (10) according to claim 1, wherein the fixed part (30) comprises a spring (54) an end of which is fixed to the first shaft (42), and wherein the movable part comprises an abutment body (76) on which the free end of the spring (54) abuts, so that the rotational motion in a first sense and the translational motion according to a first direction of the movable body (32) with respect to the fixed body (30) is counteracted by the spring (54) so as to load the spring (54) and obtain a rotational motion in an opposite sense and a translational motion according to a second direction opposite to the first one.

6. The hinges system (10) according to claim 5, wherein a stroke end element (55) is fixed to the first shaft (42), in which element a lower surface (59) inclined is obtained and a blocking element (63) is fixed to the movable body (32) and has an upper surface (67) inclined according to a conformation homologous to that of the stroke end element (55), so that the blocking element (63) abuts on the stroke end element (55) in a position of maximum opening of the wing and that in the closing phase of the wing B, the upper end of the blocking element (63) follows the profile of the lower surface (59) of the stroke end element (55) so as to avoid sudden movements of the wing B.

7. The hinges system (10) according to claim 1, wherein a stroke end element (55) is fixed to the first shaft (42), in which element a lower surface (59) inclined is obtained and a blocking element (63) is fixed to the movable body (32) and has an upper surface (67) inclined according to a conformation homologous to that of the stroke end element (55), so that the blocking element (63) abuts on the stroke end element (55) in a position of maximum opening of the wing and that in the closing phase of the wing B, the upper end of the blocking element (63) follows the profile of the lower surface (59) of the stroke end element (55) so as to avoid sudden movements of the wing B.

8. The hinges according to claim 1, wherein the second hinge (14) comprises a fixed piece (16), fixed to the fixed system F, and a movable piece (18), fixed to the wing B; the movable piece (18) being rotating and translating with respect to the fixed piece (16).

9. The hinges system (10) according to claim 8, wherein a valve (128, 130) is comprised and works in the conduit (126) to regulate the passage of fluid in the conduit (126).

10. The hinges system (10) according to claim 8, wherein a second roller (98) is rotatably coupled to the second fixed body (80), and wherein the movable piece (18) comprises a second ramp (118); the second roller (98) being in abutment and adapted to roll on the second ramp (118), so that the second rotating body (108) is rotatable around the second shaft (88) and that in the rotational motion of the second rotating body (108) with respect to the second fixed body (80), the second rotating body (108) is also forced to translate in the direction of development of the second shaft (88).

11. A hinges system (10) comprising:

a first hinge (12) and a second hinge (14), each of the first and second hinges (12, 14) being fixed at a part to a fixed system F and at the other part to a wing B;

a cam mechanism for an automatic closing of the wing B once the wing B has been opened and released; and a fluid-operated device adapted to move a fluid from a first chamber (132) to a second chamber (134) and vice versa, through rotational motion of the wing B in order to control the closing speed of the wing B, wherein the first hinge (12) comprises a cam mechanism and the second hinge (14) comprises a fluid-operated device, wherein the second hinge (14) comprises a fixed piece (16), fixed to the fixed system F, and a movable piece (18), fixed to the wing B; the movable piece (18) being rotating and translating with respect to the fixed piece (16), and wherein the fixed piece (16) comprises a second fixed body (80) which is fixed to the fixed system F and to which a second shaft (88) is rigidly coupled, a piston (100) being fixed to the free end of the second shaft (88); and wherein the movable piece (18) comprises a second rotating body (108) in which a second hole (110) is obtained and receives a gasket (124); the second shaft (88) being received in the second hole (110) so as to obtain a closed volume which the piston (100) divides into a first chamber (132) and a second chamber (134), the two chambers being communicating with each other through a conduit (126), so that in the translational motion of the movable piece (18) with respect to the fixed piece (16), a fluid contained in the first chamber (132) and in the second chamber (134) passes from the first chamber (132) to the second chamber (134) or from the second chamber (134) to the first chamber (132).

12. The hinges system (10) according to claim 11, wherein a second roller (98) is rotatably coupled to the second fixed body (80), and wherein the movable piece (18) comprises a second ramp (118); the second roller (98) being in abutment and adapted to roll on the second ramp (118), so that the second rotating body (108) is rotatable around the second shaft (88) and that in the rotational motion of the second rotating body (108) with respect to the second fixed body (80), the second rotating body (108) is also forced to translate in the direction of development of the second shaft (88).

* * * * *